US009346586B2

(12) United States Patent
Shiotani et al.

(10) Patent No.: US 9,346,586 B2
(45) Date of Patent: May 24, 2016

(54) CONTAINER

(71) Applicant: Kunimori Kagaku Co., Ltd., Aichi-ken (JP)

(72) Inventors: Yoichi Shiotani, Aichi-ken (JP); Yusaku Inayama, Aichi-ken (JP)

(73) Assignee: Kunimori Kagaku Co., Ltd., Aichi-Ken (JP)

( * ) Notice: Subject to any disclaimer, the term of this patent is extended or adjusted under 35 U.S.C. 154(b) by 0 days.

(21) Appl. No.: 14/401,072

(22) PCT Filed: Nov. 7, 2013

(86) PCT No.: PCT/JP2013/080099
§ 371 (c)(1),
(2) Date: Nov. 13, 2014

(87) PCT Pub. No.: WO2014/091842
PCT Pub. Date: Jun. 19, 2014

(65) Prior Publication Data

US 2015/0298856 A1 Oct. 22, 2015

(30) Foreign Application Priority Data

Dec. 12, 2012 (JP) ..... 2012-271458
Jun. 27, 2013 (JP) ..... 2013-135027

(51) Int. Cl.
*B65D 21/032* (2006.01)
*B65D 21/02* (2006.01)
*B65D 25/20* (2006.01)
(Continued)

(52) U.S. Cl.
CPC ..... *B65D 21/0212* (2013.01); *B65D 5/321* (2013.01); *B65D 5/324* (2013.01); *B65D 5/445* (2013.01); *B65D 11/10* (2013.01); *B65D 11/105* (2013.01); *B65D 11/26* (2013.01); *B65D21/0235* (2013.01); *B65D 25/20* (2013.01); *B65D 5/4608* (2013.01)

(58) Field of Classification Search
CPC ..... B65D 21/0212; B65D 21/0235; B65D 5/324; B65D 5/321; B65D 5/445; B65D 11/105; B65D 11/10; B65D 11/26; B65D 25/20
USPC ..... 206/511
See application file for complete search history.

(56) References Cited

U.S. PATENT DOCUMENTS 2,757,851 A * 8/1956 Moore ..... B65D 5/324 229/122.23
3,568,879 A * 3/1971 Box ..... B65D 21/0235 206/504

(Continued)

FOREIGN PATENT DOCUMENTS

CN 101175671 A 5/2008
CN 2011-65406 Y 12/2008

(Continued)

*Primary Examiner* — Stephen Castellano
(74) *Attorney, Agent, or Firm* — Cesari and McKenna LLP

(57) ABSTRACT

This container is provided with a box main body (20) configured by assembling synthetic resin hollow plates into a bottomed square box shape. A plurality of engaging members (31, 32) having rectangular protrusions (33) are fixed to a bottom wall (21) of the box main body (20). The engaging members (31, 32) are fixed in such a manner that the protrusions (33) protrude from the bottom surface of the bottom wall (21), and are positioned in such a manner that lattice-shaped linear recesses, which extend lengthwise and widthwise along the side edges of the bottom wall (21), are formed between the protrusions (33).

1 Claim, 7 Drawing Sheets

(51) Int. Cl.

| | |
|---|---|
| ***B65D 6/00*** | (2006.01) |
| ***B65D 6/34*** | (2006.01) |
| ***B65D 5/32*** | (2006.01) |
| ***B65D 5/44*** | (2006.01) |
| *B65D 5/468* | (2006.01) |

(56) References Cited

U.S. PATENT DOCUMENTS 5,429,261 A * 7/1995 Machino ..... B65D 11/184
220/4.28
2006/0144743 A1 7/2006 McDade
2007/0284378 A1 12/2007 Wang

FOREIGN PATENT DOCUMENTS

| | | |
|---|---|---|
| JP | 42-11482 | 6/1967 |
| JP | 51-84827 | 7/1975 |
| JP | 7-404994 | 2/1995 |
| JP | 2542994 | 4/1997 |
| JP | 09-165040 | 6/1997 |
| JP | 2000-43858 | 2/2000 |
| JP | 2008-024348 | 2/2008 |
| JP | 4689069 | 5/2011 |

* cited by examiner

CONTAINER

CROSS REFERENCE TO RELATED APPLICATIONS

This application is the National Stage of International Application No. PCT/JP2013/080099, filed on Nov. 7, 2013, which claims the benefit of Japanese Application No. 2012-271458, filed on Dec. 12, 2012 and Japanese Application No. 2013-135027, filed on Jun. 27, 2013. The contents of all prior applications are hereby incorporated by reference in their entirety.

BACKGROUND OF THE INVENTION

The present invention relates to a stackable container.

Patent Document 1 discloses a container stacking structure in which rectangular box-shaped plastic containers are stacked while being arranged in the same orientation by a column stacking method, and another container stacking structure in which containers are stacked while being arranged in different orientations by an interlock stacking method. The column stacking method refers to a method for vertically stacking containers while aligning the long sides and the short sides of each container stacked on top with the long sides and the short sides of the container below, respectively. In contrast, the interlock stacking method refers to a method for stacking containers in multiple layers while rotating the phase in the planer arrangement of each container stacked on top by 90 or 180 degrees relative to the container below.

The lower surface of the bottom wall of the container disclosed in Patent Document 1 has linear recesses that extend lengthwise and widthwise along the side edges of the bottom wall to form a lattice-like pattern. Thus, when containers are stacked by the column stacking method or the interlock stacking method, the upper edges of the container below are engaged with the linear recesses in the bottom wall of the container above, which restricts displacement between the containers.

Recently, to reduce the weight, containers have been used that are formed of hollow plastic plates made, for example, of corrugated plastic (for example, refer to Patent Document 2). The container disclosed in Patent Document 2 is formed by cutting a corrugated plastic into a cruciform plate including a rectangular bottom plate and side plates on the four sides of the bottom plate, folding the cruciform plate into a box shape, and attaching a reinforcing frame to the open end.

PRIOR ART DOCUMENTS

Patent Documents

Patent Document 1: Japanese Laid-Open Patent Publication No. 2008-24348

Patent Document 2: Japanese Laid-Open Patent Publication No. 9-165040

SUMMARY OF THE INVENTION

To manufacture the container of Patent Document 1, a mold having a corresponding cavity is prepared. Molten plastic is injected into the mold and hardened to mold an integrated container. Therefore, to manufacture containers of different sizes, molds need to be prepared for each size. Preparation of molds for different sizes is not desirable in view of costs and storage spaces.

On the other hand, the container of Patent Document 2, which is formed by corrugated plastic, cannot be easily formed to have complicated three-dimensional structure. That is, the corrugated plastic has a hollow internal structure. Thus, if folding portions are formed continuously, it would be difficult to maintain a sufficient strength to sustain the shape. Therefore, the bottom wall of the container of Patent Document 2 cannot be deformed to form linear recesses as in the container of Patent Document 1. The container of Patent Document 2 thus cannot be stacked stably by the column stacking method or the interlock stacking method.

Accordingly, it is an objective of the present invention to provide a container that can be stably stacked both by the column stacking method and the interlock stacking method and requires no variation of molds for different sides.

To achieve the foregoing objective and in accordance with one aspect of the present invention, a container that includes a box main body is provided. The box main body is a rectangular box with a bottom that is formed by folding a hollow plastic plate. A plurality of engaging members each having a rectangular protrusion is fixed to a bottom wall of the box main body. The protrusions of the engaging members protrude from a lower surface of the bottom wall and are arranged to form linear recesses between the protrusions. The linear recesses extend lengthwise and widthwise along side edges of the bottom wall and form a lattice-like pattern.

According to the above configuration, the box main body, which is shaped like a rectangular box with a bottom, is formed by a hollow plate such as a corrugated plastic plate. Therefore, box main bodies of different sizes can be manufactured by changing the size of the plates cutout from the hollow plate. Thus, unlike the conventional container, different molds are not required for different sizes.

Also, according to the above configuration, the engaging members, which are formed separately from the box main body and have protrusions, are arranged on the bottom wall of the box main body in a predetermined arrangement to form lattice-patterned linear recesses on the lower surface of the bottom wall to extend lengthwise and widthwise along the side edges of the bottom wall. Therefore, when the box main body is formed using the hollow plate, the lattice-patterned linear recesses can be easily provided on the lower surface of the bottom wall, so that containers that can be easily stacked both by the column stacking method and the interlock stacking method are obtained. Further, in a case in which containers of different sizes are needed, the number of engaging members is changed in correspondence with the size of each box main body. That is, identical engaging members can be used for containers of different sizes.

In the above described container, each engaging member preferably includes one of the protrusions bulging downward and a flat portion extending horizontally from a periphery of the protrusion. Since each engaging member has a flat portion, the engaging member is stably attached to the box main body.

In the above described container, a reinforcing plate is preferably stacked on the lower surface of the bottom wall, and the engaging members are preferably arranged between the bottom wall and the reinforcing plate. Also, the reinforcing plate preferably has through holes through which the protrusions of the engaging members extend.

In the above described container, a reinforcing plate is preferably stacked on an upper surface of the bottom wall, and the engaging members are preferably arranged between the bottom wall and the reinforcing plate. Also, the bottom wall preferably has through holes through which the protrusions of the engaging members extend.

These configurations increase the strength of the bottom wall of the container. Also, since the engaging members are arranged between the bottom wall and the reinforcing plate, the engaging members are prevented from falling off the box main body.

In the above described container, the box main body preferably includes a primary plate and a secondary plate. In this case, the primary plate has two primary side walls facing each other and a primary bottom wall connecting the primary side walls to each other, and the secondary plate has two secondary side walls facing each other and a secondary bottom wall connecting the secondary side walls to each other. The secondary bottom wall of the secondary plate is preferably stacked on the primary bottom wall of the primary plate to form a rectangular box with a bottom, and the engaging members are preferably arranged between the primary bottom wall and the secondary bottom wall. Further, the primary bottom wall preferably has through holes through which the protrusions of the engaging members extend. In this case, since the bottom wall of the box main body has a double-layered structure with the primary bottom wall of the primary plate and the secondary bottom wall of the secondary plate, the strength of the bottom wall of the container is increased. Also, compared to a case in which the box main body is formed of a single plate, a larger box main body can be easily formed.

The containers of the present invention can be stably stacked both by the column stacking method and the interlock stacking method. Also, containers of different sizes can be manufactured without using molds of different sizes.

BRIEF DESCRIPTION OF THE DRAWINGS

FIG. 3(*b*) is a partial side view of the container according to the first embodiment;

DETAILED DESCRIPTION OF THE PREFERRED EMBODIMENTS

First Embodiment

A container 10 according to a first embodiment of the present invention will now be described with reference to FIGS. 1 to 4.

Figure 1:
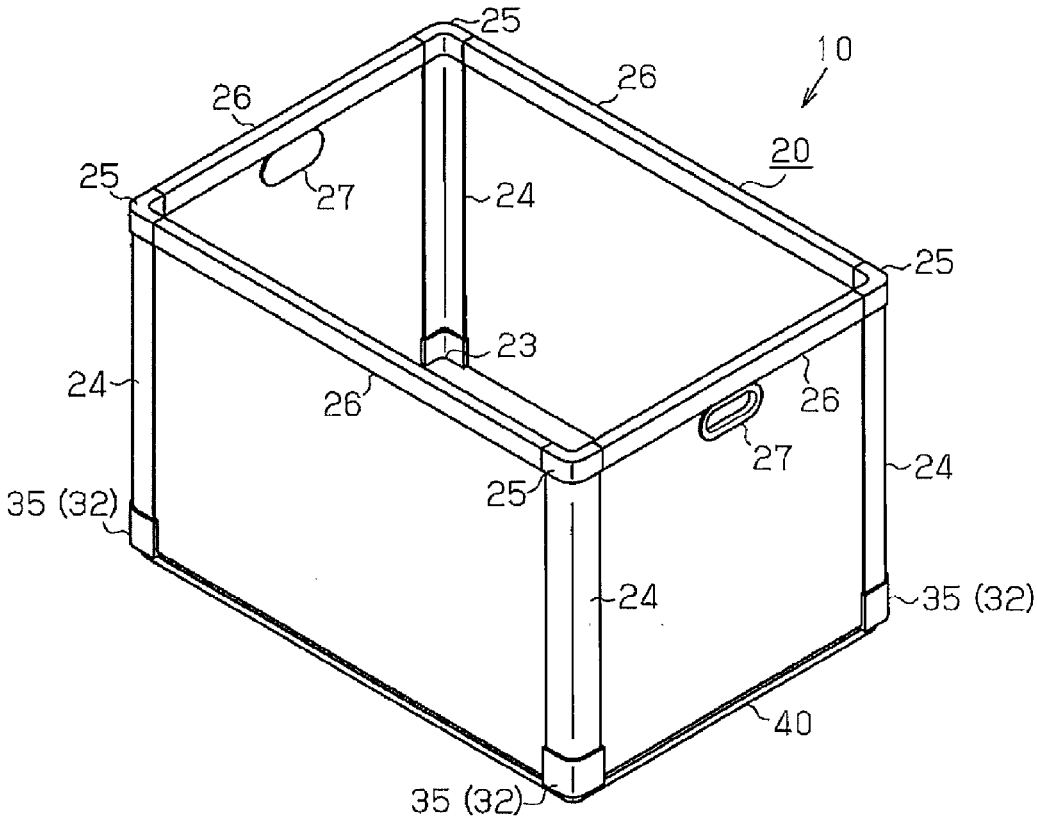
FIG. 1 is a perspective view illustrating a container according to a first embodiment.
Figure 4:
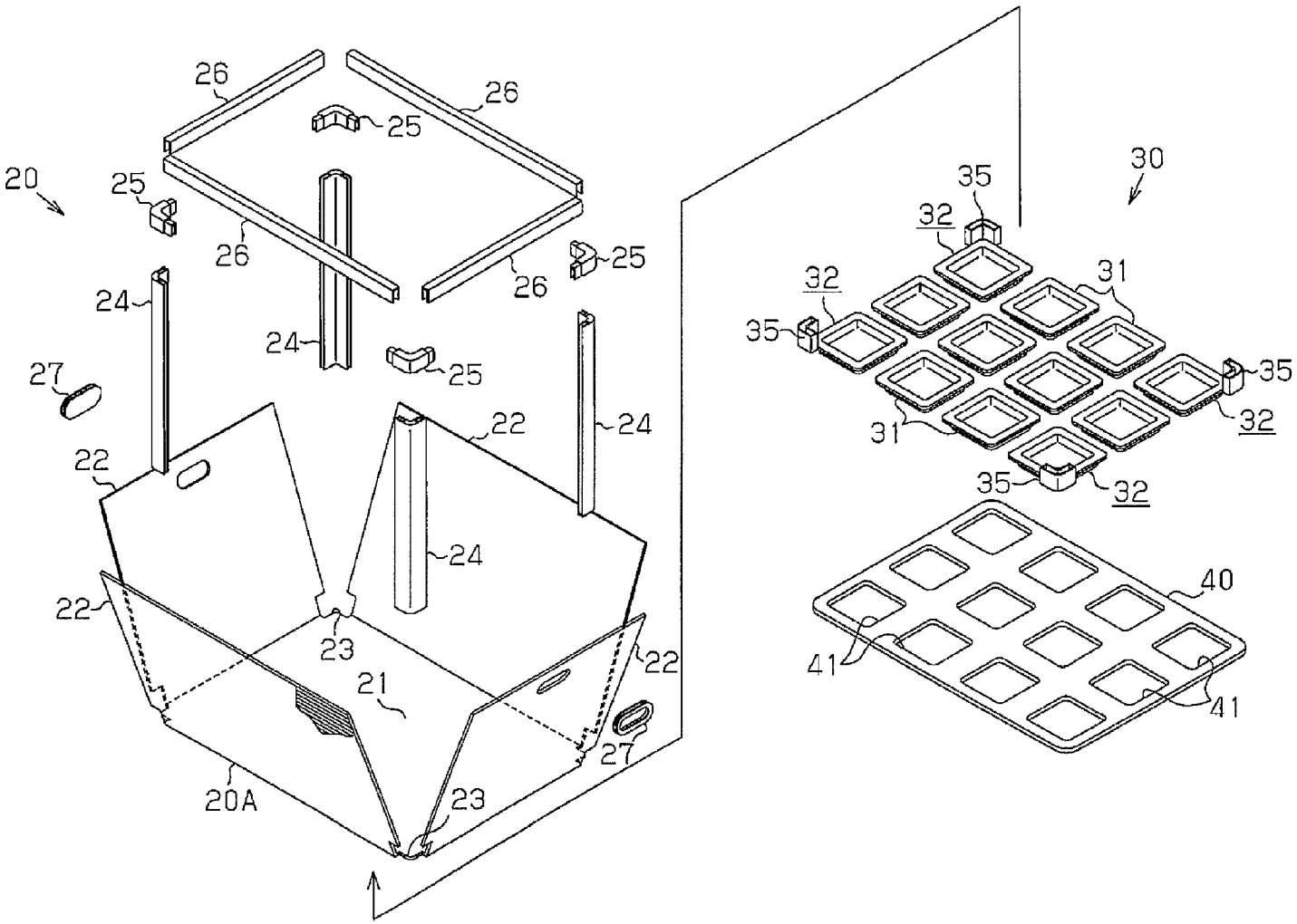
FIG. 4 is an exploded perspective view of the container according to the first embodiment.

As shown in FIGS. 1 and 4, the container 10 includes a box main body 20 that has a bottom and an upper opening. The box main body 20 is formed by folding a plate 20A into a box shape. The plate 20A includes a rectangular bottom wall 21 and rectangular side walls 22 each connected to one of the four side edges of the bottom wall 21. When deployed, the plate 20A has a cruciform shape in a plan view. The plate 20A is cut out from a hollow plastic plate such as a corrugated plastic plate or a foamed sheet. A corrugated plastic plate includes a pair of surface layers and a middle layer, which is located between the surface layers and has an uneven surface with crank-shaped or cone-shaped protrusions. The plate 20A has notches 23 at the four corners of the bottom wall 21 and on both sides of the lower portions of the side walls 22.

A vertically extending post frame 24 is attached between each adjacent pair of the side walls 22 of the box main body 20. The post frame 24 is a rod-like member of an L-shaped cross section with grooves on both side edges. The side walls 22 are inserted into the grooves on the side edges of the post frames 24 to secure the post frames 24 to the side walls 22, so that adjacent ones of the side walls 22 are coupled to each other via the post frame 24.

A corner frame 25 is attached to each corner of the open edge of the box main body 20 (the sides of the upper edges of the side walls 22). The corner frames 25 are L-shaped members with a U-shaped cross section and a groove on the lower surface. The upper ends of the post frames 24 and the upper edges of the side walls 22 are inserted in the grooves in the lower surfaces of the corner frames 25, so that the corner frames 25 are fixed to the post frames 24 and the side walls 22.

An upper edge frame 26 is attached to the edge of each upper end of the box main body 20 (the upper edge of each side wall 22) to extend along the open edge. The upper edge frames 26 are rod-like members of a U-shaped cross section with a groove on the lower surface. The upper edges of the side walls 22 are inserted in the grooves in the lower surfaces of the upper edge frames 26, so that the upper edge frames 26 are fixed to the side walls 22. The grooves of the upper edge frames 26 receive the ends of the corner frames 25 together with the upper edges of the side walls 22. This couples the corner frames 25 and the upper edge frames 26 to each other.

The post frames 24, the corner frames 25, and the upper edge frames 26 are plastic members formed by injection molding or extrusion and serve as reinforcing portions that reinforce the box main body 20. The corner frames 25 and the upper edge frames 26 also serve as placement portions when the containers 10 are stacked. Holding portions 27 are attached to a pair of opposed side walls 22.

Figure 2:
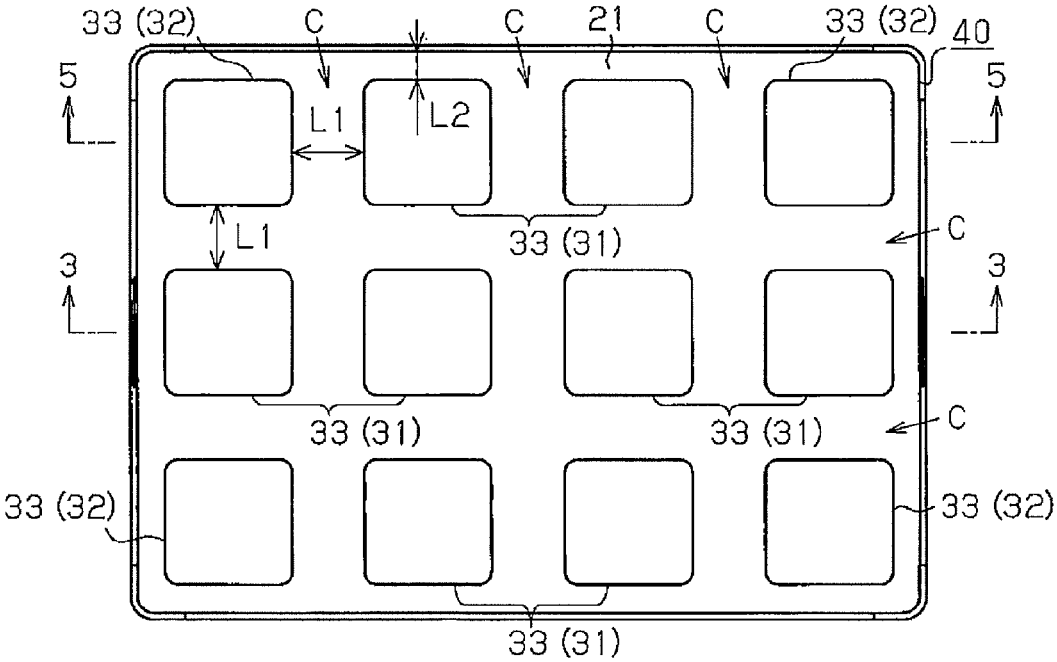
FIG. 2 is a bottom view of the container according to the first embodiment.
Figure 3A:
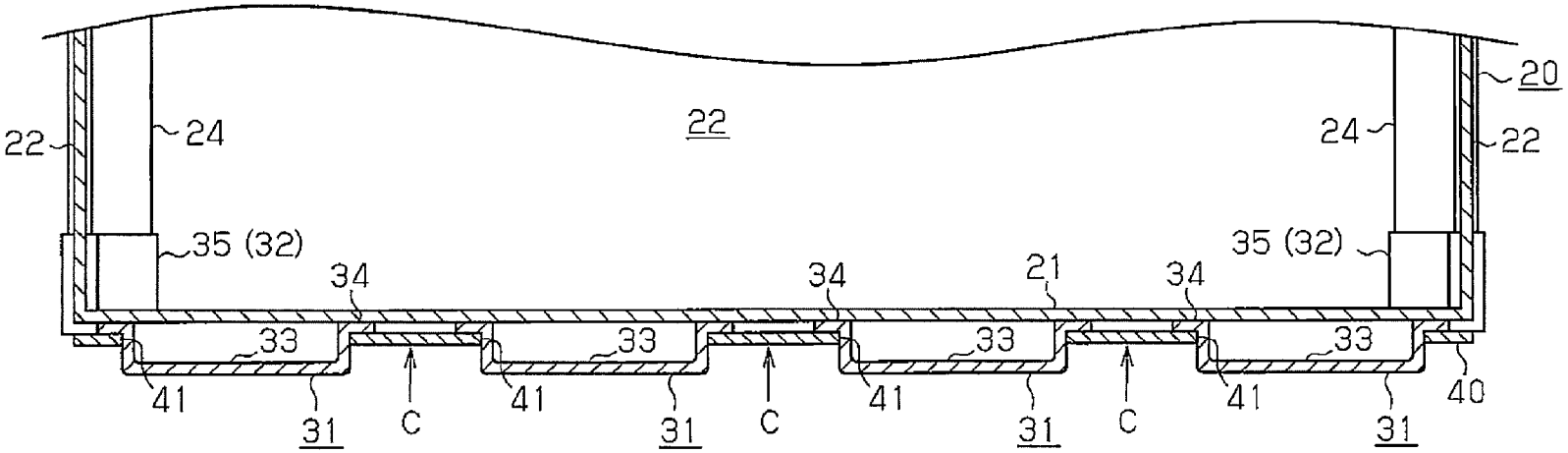
FIG. 3(*a*) is a partial cross-sectional view taken along line 3-3 of FIG. 2.
Figure 3B:
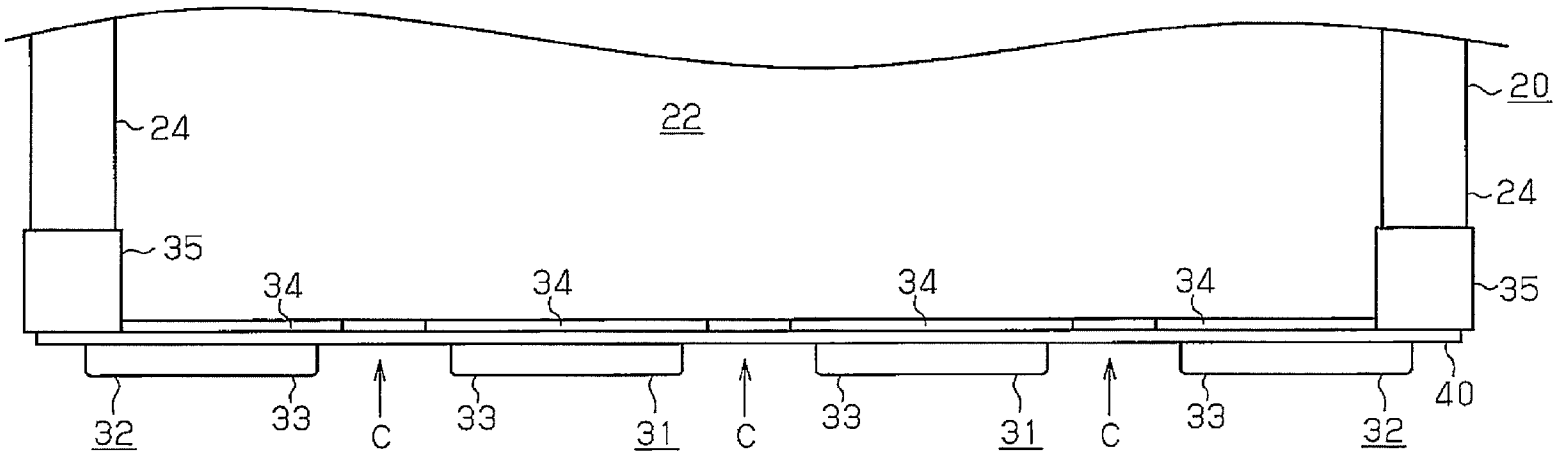

As shown in FIGS. 2 to 4, a plurality of engaging members 30 are fixed to the lower surface of the bottom wall 21 of the box main body 20. The engaging members 30 are arranged lengthwise and widthwise at equal intervals along the side edges of the bottom wall 21 (refer to FIG. 2). In the present embodiment, a total of twelve engaging members 30 are provided in four rows in the longitudinal direction and in three rows in the transverse direction.

As shown in FIGS. 3 and 4, the engaging members 30 include primary engaging members 31 provided at positions other than the four corners of the bottom wall 21 and secondary engaging members 32 provided at the four corners of the bottom wall 21. Each primary engaging member 31 has a protrusion 33, which bulges downward and has a rectangular shape in a plan view, and a flange-like flat portion 34, which horizontally extends from the edge of the protrusion 33, so that the primary engaging member 31 has a rectangular dish-like shape as a whole.

Like the first engaging members 31, the secondary engaging members 32 are rectangular dish-like members each having a protrusion 33 and a flat portion 34. Each secondary engaging member 32 has an integrally formed frame engagement portion 35 at a corner of the flat portion 34. Each frame engagement portion 35 is an L-shaped portion extending vertically and has on the upper surface a groove for receiving the lower end of the corresponding post frame 24. The primary engaging members 31 and the secondary engaging members 32 are plastic members formed, for example, by injection molding.

As shown in FIGS. 3(*a*) and 3(*b*), the primary engaging members 31 and the secondary engaging members 32 are heat welded, at the upper surface of the flat portions 34, to the lower surface of the bottom wall 21 of the box main body 20. The frame engagement portions 35 of the secondary engaging members 32 located in the notches 23 formed in the box main body 20. The lower ends of the post frames 24 are inserted in the grooves of the frame engagement portions 35, so that the secondary engaging members 32 and the post frames 24 are fixed to each other.

As shown in FIG. 2, since the primary engaging members 31 and the secondary engaging members 32 are arranged lengthwise and widthwise on the lower surface of the bottom wall 21 of the box main body 20, linear recesses C, which are recessed with respect to the protrusions 33, are formed in the lower surface of the bottom wall 21. Since the protrusions 33 are rectangular, the linear recesses C form a lattice pattern, while extending lengthwise and widthwise along the sides of the bottom wall 21.

The distance L1 between adjacent protrusions 33 of the primary engaging members 31 and the secondary engaging members 32 (the width of each linear recess C) is set to be slightly larger than double the width of the upper surface of the upper edge frames 26. Also, the distance L2 between the protrusion 33 of a primary engaging member 31 or a secondary engaging member 32 and the corresponding side edge of the bottom wall 21 is set to be slightly larger than the width of the upper surface of the upper edge frames 26.

As shown in FIGS. 3(*a*), 3(*b*), and 4, a reinforcing plate 40 is stacked on the lower surface of the bottom wall 21 of the box main body 20 with the engaging members 30 in between. The reinforcing plate 40 has the same outer shape as the bottom wall 21 of the box main body 20 and is made of a hollow plate like the plate 20A, which forms the box main body 20.

The reinforcing plate 40 has through holes 41, which have the same shape as the outer shape of the protrusions 33 of the engaging members 30. In the reinforcing plate 40, the through holes 41 are arranged lengthwise and widthwise along the sides of the reinforcing plate 40 in correspondence with the arrangement of the protrusions 33 of the engaging members 30 fixed to the bottom wall 21 of the box main body 20. The reinforcing plate 40 is stacked on the bottom wall 21 of the box main body 20 with the protrusions 33 of the engaging members 30 protruding from the reinforcing plate 40 through the through holes 41. The reinforcing plate 40 is heat welded to the lower surfaces of the flat portions 34 of the engaging members 30.

Operation of the container 10 according to the present embodiment will now be described.

The container 10 of the present embodiment has the engaging members 30, each of which has a rectangular protrusion 33, on the lower surface of the bottom wall 21 of the box main body 20. The engaging members 30 are arranged to form lattice-patterned linear recesses C, which are located between the protrusions 33 and extend lengthwise and widthwise along the side edges of the bottom wall 21. This allows the containers 10 to be stably stacked both by the column stacking method and the interlock stacking method.

When stacking the containers 10 by the column stacking method, in which the orientations of the containers 10 are the same, the upper edge frames 26 of the container 10 below are arranged in recesses between a side edge and engaging members 30 of the bottom wall 21 on the lower surface of the container 10 above. When stacking the containers 10 by the interlock stacking method, in which the orientations of the containers 10 are different, the upper edge frames 26 of the container 10 below are arranged in linear recesses C on the lower surface of the container 10 above.

As described above, when the containers 10 are stacked either by the column stacking method or the interlock stacking method, the inner surfaces of the upper edge frames 26 of the container 10 below contact the engaging members 30 of the container 10 above, which restricts displacement between the containers 10. As a result, the column stacking state and the interlock stacking state are stabilized.

The present embodiment achieves the following advantages.

(1) The container 10 includes the box main body 20, which is formed by folding the hollow plastic plate 20A into a rectangular box with a bottom. The engaging members 30, each of which has a rectangular protrusion 33, are fixed to the bottom wall 21 of the box main body 20. The engaging members 30 are fixed to the lower surface of the bottom wall 21 such that the protrusions 33 protrude. The engaging members 30 are also arranged to form the lattice-patterned linear recesses C, which are arranged between the protrusions 33 and extend lengthwise and widthwise along the side edges of the bottom wall 21.

According to the above described configuration, when the box main body 20 is formed using a hollow plate, the lattice-patterned linear recesses C can be easily provided on the lower surface of the bottom wall 21 of the box main body 20, so that containers that can be easily stacked both by the column stacking method and the interlock stacking method are obtained.

Further, box main bodies 20 of different sizes can be manufactured by changing the size of the plate 20A cutout from a hollow plate. Thus, unlike the conventional container, different molds are not required for different sizes. Further, in a case in which containers 10 of different sizes are needed, the number of engaging members 30 is changed in correspondence with the size of each box main body 20. That is, identical engaging members 30 can be used for containers 10 of different sizes. Thus, different molds for molding the engaging members 30 are not required for different sizes of containers 10.

(2) The reinforcing plate 40 is stacked on the bottom wall 21 of the box main body 20. This increases the strength of the bottom wall 21.

(3) The reinforcing plate 40 has the through holes 41, through which the protrusions 33 of the engaging members 30 extend. The reinforcing plate 40 is stacked on the lower surface of the bottom wall 21 of the box main body 20 such that the protrusions 33 of the engaging members 30 protrude from the through holes 41.

According to this configuration, when attached to the box main body 20, the engaging members 30 are first arranged in the reinforcing plate 40 while using the through holes 41 as positioning portions. Thereafter, the engaging members 30 and the reinforcing plate 40 are stacked on the bottom wall 21 of the box main body 20. This allows the engaging members 30 to be easily positioned at the specific positions for forming the linear recesses C. Also, since the engaging members 30 are arranged between the bottom wall 21 and the reinforcing plate 40, the engaging members 30 are prevented from falling off the box main body 20.

Second Embodiment

A container according to a second embodiment will now be described. The present embodiment is different from the first embodiment in structure of the bottom wall 21 of the box main body 20 and the reinforcing plate 40. The differences will mainly be discussed below.

Figure 6:
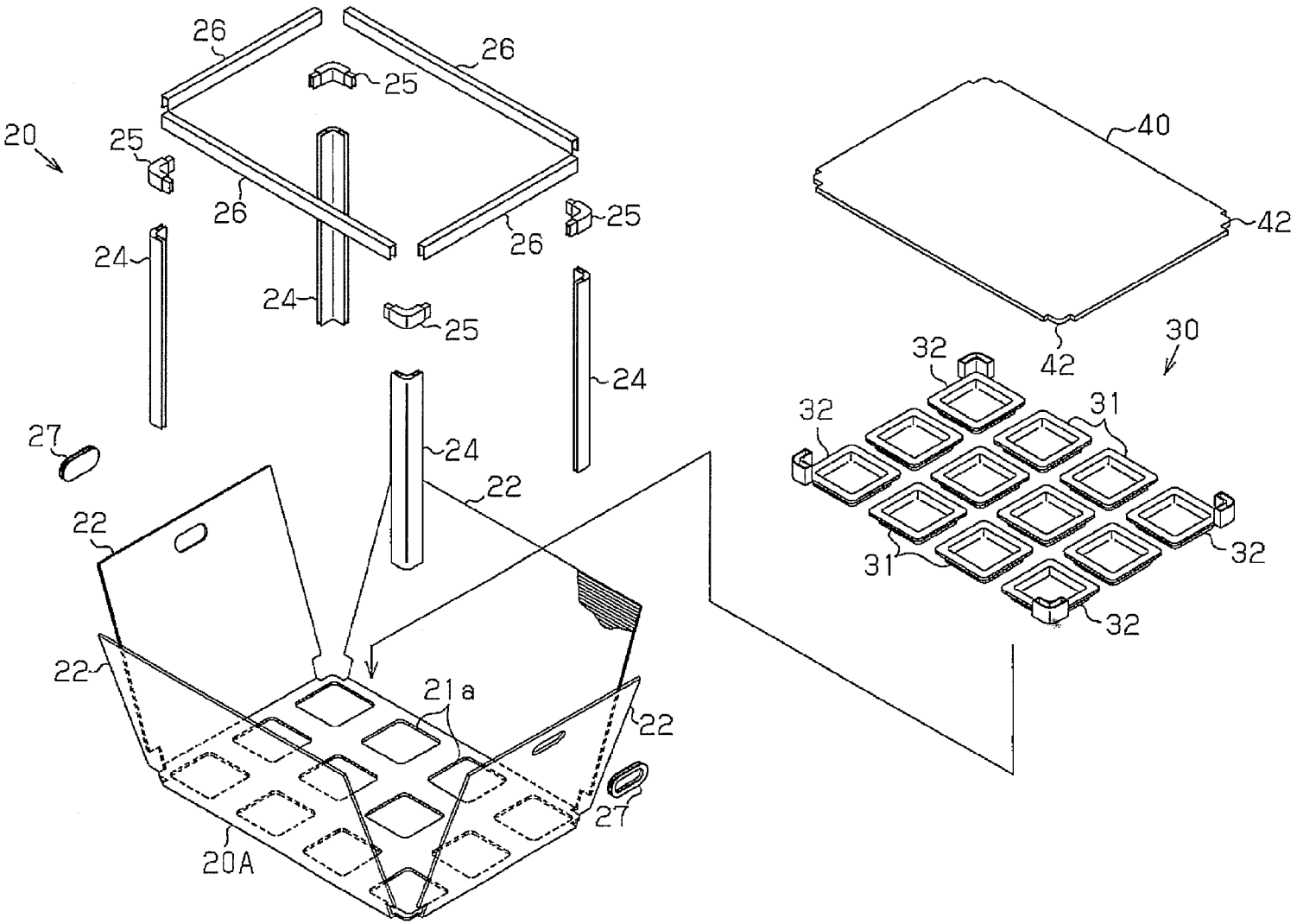
FIG. 6 is an exploded perspective view illustrating a container according to a second embodiment.

As shown in FIG. 6, the bottom wall 21 of the box main body 20 has through holes 21*a*, which are arranged lengthwise and widthwise along the sides of the bottom wall 21. In the present embodiment, a total of twelve through holes 21*a* are formed in four rows in the longitudinal direction and in three rows in the transverse direction. The through holes 21*a* have the same shape as the outer shape of the protrusions 33 of the engaging members 30.

The engaging members 30 are arranged lengthwise and widthwise on the upper surface of the bottom wall 21 such that the protrusions 33 protrude from the lower surface of the bottom wall 22 through the through holes 21*a*. Specifically, the secondary engaging members 32 are arranged such that the protrusions 33 of the secondary engaging members 32 extend through the through holes 21*a* located at the four corners of the bottom wall 21. The primary engaging members 31 are arranged such that the protrusions 33 of the primary engaging members 31 extend through the through holes 21*a* at positions other the four corners of the bottom wall 21. The primary engaging members 31 and the secondary engaging members 32 are fixed to the bottom wall 21 by heat welding the lower surfaces of the flat portions 34 to the upper surface of the bottom wall 21.

A reinforcing plate 40 is stacked on the upper surface of the bottom wall 21 with the flat portions 34 of the engaging members 30 in between. The reinforcing plate 40 has, at the four corners, notches 42 to avoid interference between the secondary engaging members 32 and the frame engagement portions 35. Also, unlike the first embodiment, the reinforcing plate 40 of the present embodiment does not have through holes 41. The reinforcing plate 40 is fixed to the upper surface of the bottom wall 21 of the box main body 20 with the engaging members 30 in between by being heat welded to the flat portions 34 of the engaging members 30.

The container according to the second embodiment achieves the same advantages as the first embodiment.

Third Embodiment

A container according to a third embodiment will now be described with reference to FIGS. 7 to 9.

Figure 7:
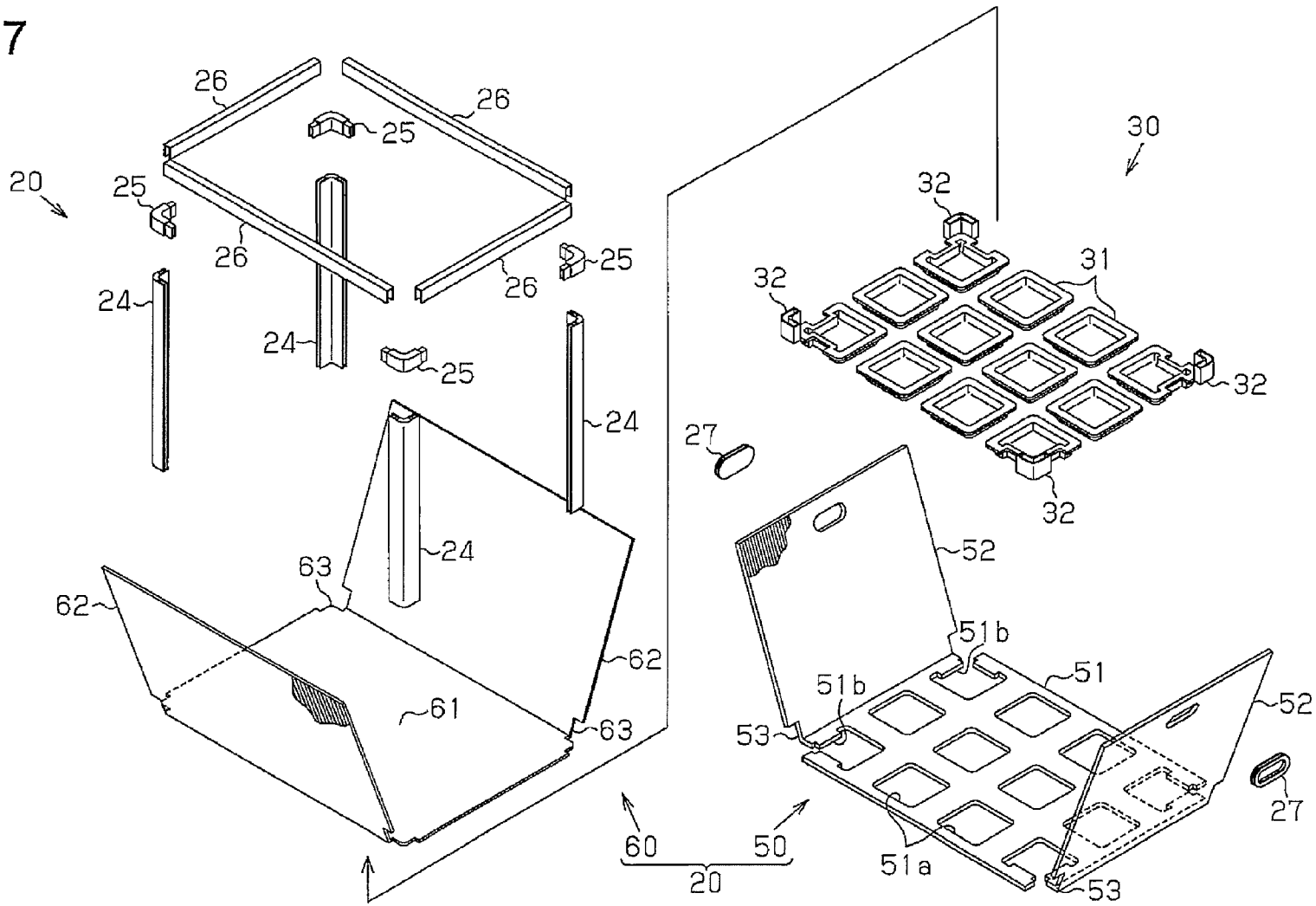
FIG. 7 is an exploded perspective view illustrating a container according to a third embodiment.

As illustrated in FIG. 7, in the present embodiment, a primary plate 50 and a secondary plate 60 are combined to form a box main body 20 having a bottom and an open end.

The primary plate 50 includes an elongated plate having a rectangular primary bottom wall 51 and short side walls 52 (primary side walls) each connected to a short side of the primary bottom wall 51. The primary plate 50 is formed to have a U-shape by folding the elongated plate along the short sides of the primary bottom wall 51. The primary plate 50 has through holes 51*a*, which are arranged lengthwise and widthwise along the side edges of the primary bottom wall 51. In the present embodiment, a total of twelve through holes 51*a* are formed in four rows in the longitudinal direction and in three rows in the transverse direction. The through holes 51*a* have the same shape as the outer shape of the protrusions 33 of the engaging members 30. Notches 53 are formed at the four corners of the primary bottom wall 51 and on both sides of the lower portions of the short side walls 52 to avoid interference between the secondary engaging members 32 and the frame engagement portions 35.

The secondary plate 60 includes an elongated plate having a rectangular secondary bottom wall 61 and long side walls 62 (secondary side walls) each connected to a long side of the secondary bottom wall 61. The secondary plate 60 is formed to have a U-shape by folding the elongated plate along the long sides of the secondary bottom wall 61. Notches 63 are formed at the four corners of the secondary bottom wall 61 of the secondary plate 60 and on both sides of the lower portions of the long side walls 62 to avoid interference between the secondary engaging members 32 and the frame engagement portions 35. The box main body 20 is formed by stacking the primary plate 50 and the secondary plate 60 together such that the secondary bottom wall 61 of the secondary plate 60 is placed on the primary bottom wall 51 of the primary plate 50 with the engaging members 30 located in between.

Specifically, the engaging members 30 are arranged lengthwise and widthwise on the upper surface of the primary bottom wall 51 of the primary plate 50 such that the protrusions 33 protrude from the lower surface of the primary bottom wall 51 through the through holes 51*a*. The secondary engaging members 32 are arranged such that the protrusions 33 extend through the through holes 51*a* located at the four corners of the bottom wall 21. The primary engaging members 31 are arranged such that the protrusions 33 of the primary engaging members 31 extend through the through holes 51*a* at positions other the four corners of the bottom wall 21. The primary engaging members 31 and the secondary engaging members 32 are positioned by engaging the lower surfaces of the flat portions 34 to the upper surface of the primary bottom wall 51.

The box main body 20 is formed by stacking the primary plate 50 and the secondary plate 60 together such that the secondary bottom wall 61 of the secondary plate 60 is placed on the upper surface of the primary bottom wall 51 of the primary plate 50 with the flat portions 34 of the engaging members 30 located in between. In the box main body 20, the primary plate 50 and the secondary plate 60 are integrated by joining the upper surface of the primary bottom wall 51 and the lower surface of the secondary bottom wall 61. Specifically, joint portions D1, D2 provided on the surfaces are joined by ultrasonic welding. The engaging members 30 are fixed to the box main body 20 by being held between the primary bottom wall 51 and the secondary bottom wall 61, which are joined at the joint portions D1, D2.

Figure 8:
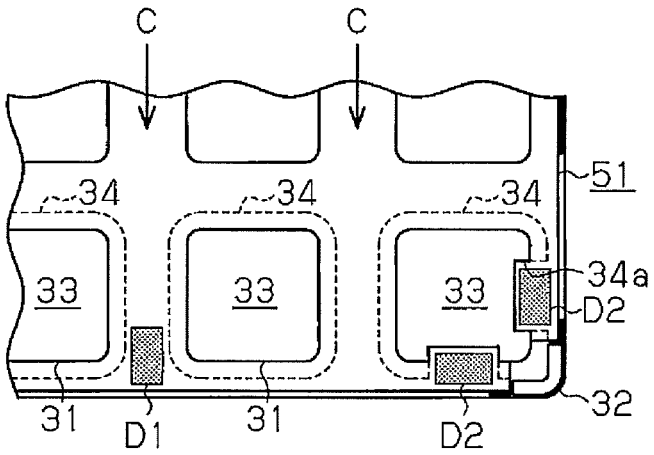
FIG. 8 is a bottom view of the container according to the third embodiment.

As shown in FIG. 8, the joint portions D1 are each provided at a part of a linear recess C in the primary bottom wall 51 where the upper surface of the primary engaging member 31 and the lower surface of the secondary bottom wall 61 directly face each other without any flat portion 34 of the primary engaging member 31 in between. The joint portions D2 are each provided at a position between the secondary engaging member 32 and a side of the primary bottom wall 51 (and a side of the secondary bottom wall 61).

Figure 9:
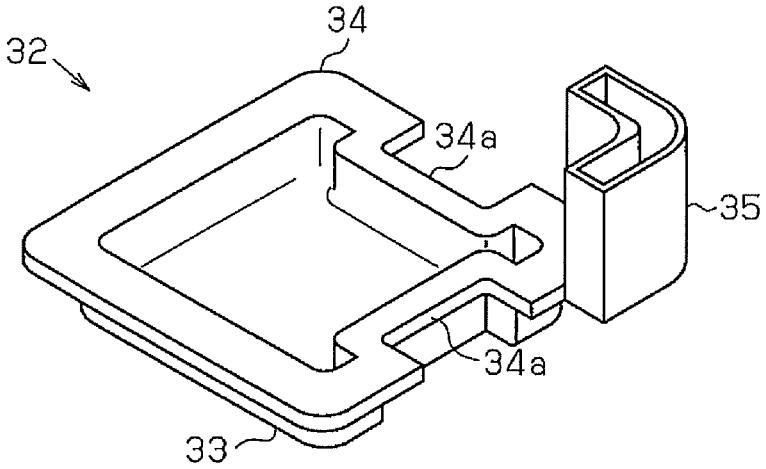
FIG. 9 is a perspective view illustrating a secondary engaging member.

As shown in FIG. 9, each secondary engaging member 32 has recesses 34*a*, which are recessed toward the protrusion 33, in the flat portion 34 at positions adjacent to the frame engagement portion 35. As shown in FIGS. 7 and 8, the bottom wall 51 of the primary plate 50 has bulging portions 51*b* in some of the through holes 51*a*. The bulging portions 51*b* bulge inward and are located at positions corresponding to the recesses 34*a* of the flat portions 34 of the secondary engaging members 32. Each joint portion D2 is provided at a position where a bulging portion 51*b* of the primary bottom wall 51 and the lower surface of the secondary bottom wall 61 face each other through a recess 34*a* of the flat portion 34 of the corresponding secondary engaging member 32.

The container according to the third embodiment achieves the same advantages as the advantages (1) to (3) of the first embodiment. The third embodiment further achieves the following advantages.

(4) The hollow plate used for the box main body 20 is formed by extrusion or laminating elongated sheets. Due to such manufacturing methods, the hollow plate is often formed to have an elongated shape. When a container is manufactured using such elongated hollow plates, the size, specifically, the vertical dimension of the container can be easily increased compared to the first embodiment.

When the cruciform plate 20A, which is used to form the box main body 20 of the first embodiment, shown in FIG. 4 is cut out from an elongated hollow plate, the widthwise direction of the hollow plate is aligned with a first direction, in which the bottom wall 21 and an opposed pair of the side walls 22 (the short side walls) are arranged, and the longitudinal direction of the hollow plate is aligned with a second direction, in which the bottom wall 21 and the other opposed pair of the side walls 22 (the long side walls) are arranged. When the length in the first direction is matched with the widthwise dimension of the hollow plate, the maximum size of the plate 20A can be cut out. Thus, the length of the plate 20A in the first direction cannot be set longer than the widthwise dimension of the hollow plate. As a result, the maximum value of the size of the side walls 22 in one pair (the short side walls), that is, the height of the box main body 20, is limited by the widthwise dimension of the hollow plate.

In contrast, the box main body 20 of the third embodiment shown in FIG. 7 is formed by the elongated primary plate 50, which is formed by the primary bottom wall 51 and the two short side walls 52, and the elongated secondary plate 60, which is formed by the secondary bottom wall 61 and the two long side walls 62. That is, the member having the short side walls 52 (the primary plate 50) and the member having the long side walls 62 (the secondary plate 60) are separate from each other. Thus, when cutting out the primary plate 50 and the secondary plate 60 from hollow plates, both of the primary plate 50 and the secondary plate 60 can be cut out while matching the directions in which the bottom wall and the side walls are matched with the longitudinal direction of the hollow plates. Accordingly, the size, that is, the height of any of the side walls, can be set freely without being limited by the widthwise dimension of the hollow plates.

The above embodiments may be modified as follows. Further, the above embodiments may have any configuration achieved by combining the following modifications.

In the above illustrated embodiments, containers 10 of the same size are stacked by the column stacking method or the interlock stacking method. However, the present invention may be applied to cases in which containers 10 of different sizes are stacked. For example, even in a case in which a large container (not shown) is placed over a number of small containers (not shown) arranged in the same plane or in a case in which a number of small containers are stacked on a large container, it is possible to prevent displacement between the upper and lower containers by causing the inner surfaces of the upper edge frames 26 of the containers 10 below and the engaging members 30 of the containers 10 above to contact each other.

As long as it is formed by folding a hollow plate into a rectangular box shape with a bottom, the box main body 20 is not limited to having any specific structure. For example, the post frames 24, the corner frames 25, and the upper edge frames 26 may be omitted. In this case, for example, margins for bonding are provided on the side walls 22 of the plate 20A, which forms the box main body 20, and the bonding margins are bonded to the adjacent side wall 22. The box main body 20 may be formed as a rectangular box shape with a bottom by assembling five plates that have been separately cut out to have the shapes of the bottom wall 21 and the side walls 22.

In the first embodiment, among the engaging members 30 fixed to the bottom wall 21 of the box main body 20, the ones arranged at the four corners of the bottom wall 21 are the secondary engaging members 32, which have the frame engagement portions 35. However, all the engaging members 30 may be the primary engaging members 31. The same applies to the second and third embodiments.

As long as it has a substantially rectangular shape in a plan view, the protrusion 33 of each engaging member 30 is not limited to any specific structure. For example, the protrusions 33 may be hollow, formed by substantially rectangular frames, or formed by a frame and ribs extending within the frame. If such a change to the protrusions 33 results in upper portions of the protrusions 33 contacting the bottom wall 21 of the box main body 20, the flat portions 34 may be omitted and the engaging members 30 and the bottom wall 21 may be bonded to each other at the protrusions 33.

Two or more of the engaging members 30 may be coupled together to form an engaging member 30 having multiple protrusions 33. For example, an engaging member 30 having one row of protrusions 33, and such engaging members 30 may be arranged in the longitudinal direction.

In the first and second embodiments, the reinforcing plate 40 may be omitted.

In the first embodiment, the engaging members 30 are fixed to the lower surface of the bottom wall 21 of the box main body 20. However, the engaging members 30 may be fixed to the upper surface of the bottom wall 21. The engaging members 30 fixed to the upper surface of the bottom wall 21 may be mixed with the engaging members 30 fixed to the lower surface of the bottom wall 21.

Figure 5:
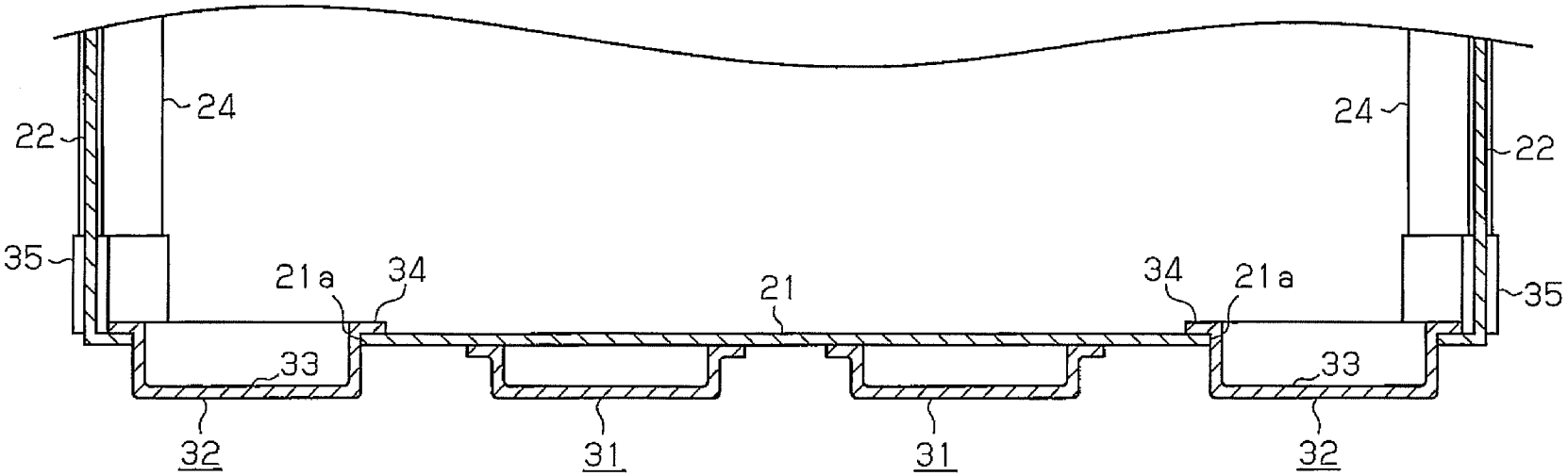
FIG. 5 is a cross-sectional view taken along line 5-5 of FIG. 2, illustrating a modification.

For example, in the example shown in FIG. 5, the secondary engaging members 32 at the four corners of the bottom wall 21 are fixed to the upper surface of the bottom wall 21. Specifically, a through hole 21*a*, which has the same outer shape as that of the protrusion 33 of the secondary engaging member 32, is formed in the vicinity of each of the four corners of the bottom wall 21. The secondary engaging members 32 are arranged on the upper surface of the bottom wall 21 such that only the protrusions 33 is exposed to the outside through the through hole 21*a*, and the lower surfaces of the flat portions 34 are fixed to the upper surface of the bottom wall 21. In this structure, when the containers 10 are stacked, the load acting on the secondary engaging members 32 is received by the bottom wall 21 of the box main body 20 via the post frames 24. This increases the strength of the container 10. In the example of FIG. 5, the reinforcing plate 40 is omitted.

In the first and second embodiments, the method for fixing the engaging members 30 to the bottom wall 21 of the box main body 20 and the reinforcing plate 40 is not particularly limited. In the third embodiment, the method for fixing the primary bottom wall 51 of the primary plate 50 and the secondary bottom wall 61 of the secondary plate 60 together is not particularly limited. For example, the fixation may be achieved by adhesive or fasteners like screws and rivets. Also, in the first and second embodiments, the components may be fixed by joining the bottom wall 21 and the reinforcing plate 40 to each other by ultrasonic welding. In the third embodiment, the components may be fixed by heat welding the primary bottom wall 51, the flat portions 34 of the engaging members 30, and the secondary bottom wall 61 together.

DESCRIPTION OF THE REFERENCE NUMERALS

C . . . Linear Recess, 10 . . . Container, 20 . . . Box Main Body, 20A . . . Plate, 21 . . . Bottom Wall, 22 . . . Side Wall, 30 . . . Engaging member, 31 . . . Primary engaging member, 32 . . . Secondary engaging member, 33 . . . Protrusion, 34 . . . Flat Portion, 40 . . . Reinforcing Plate, 41 . . . Through Hole, 50 . . . Primary plate, 51 . . . Primary bottom wall, 51*a* . . . Through Hole, 52 . . . Short Side Wall (Primary side wall), 60 . . . Secondary plate, 61 . . . Secondary bottom wall, 62 . . . Long Side Wall (Secondary side wall).

The invention claimed is:

1. A container comprising a box main body, wherein the box main body is a rectangular box with a bottom that is formed by folding a hollow plastic plate, and a plurality of engaging members each having a rectangular protrusion is fixed to a bottom wall of the box main body, the container being characterized in that the protrusions of the engaging members protrude from a lower surface of the bottom wall and are arranged to form linear recesses between the protrusions, wherein the linear recesses extend lengthwise and widthwise along side edges of the bottom wall and form a lattice-like pattern, each engaging member includes one of the protrusions bulging downward, and a flat portion extending from an outer periphery of an upper part of the protrusion, and the box main body includes a primary plate having two primary side walls facing each other and a primary bottom wall connecting the primary side walls to each other, and a secondary plate having two secondary side walls facing each other and a secondary bottom wall connecting the secondary side walls to each other, the secondary bottom wall of the secondary plate is stacked on the primary bottom wall of the primary plate to form a rectangular box with a bottom, the engaging members are arranged between the primary bottom wall and the secondary bottom wall, and the primary bottom wall has through holes through which the protrusions of the engaging members extend.

* * * * *